US005800135A

United States Patent [19]

Merz

[11] Patent Number: 5,800,135

[45] Date of Patent: Sep. 1, 1998

[54] SLIDING VANE PUMP USING A DRIVE SHAFT AS A FLOW DIVIDER FOR ENHANCED OIL CIRCULATION

[75] Inventor: Johann Merz, Schwäbisch Gmünd, Germany

[73] Assignee: ZF Friedrichshafen AG., Friedrichshafen, Germany

[21] Appl. No.: 817,518

[22] PCT Filed: Oct. 21, 1995

[86] PCT No.: PCT/EP95/04129

§ 371 Date: Apr. 17, 1997

§ 102(e) Date: Apr. 17, 1997

[87] PCT Pub. No.: WO96/13665

PCT Pub. Date: May 9, 1996

[30] Foreign Application Priority Data

Oct. 29, 1994 [DE] Germany ..... 44 38 696.6

[51] Int. Cl.[6] ..... F04B 49/00

[52] U.S. Cl. ..... 417/300; 417/308; 417/310

[58] Field of Search ..... 417/300, 308, 417/310

[56] References Cited

U.S. PATENT DOCUMENTS 2,981,067 4/1961 Clark et al. ..... 417/300

5,236,315 8/1993 Hamao et al. ..... 417/308

*Primary Examiner*—Timothy Thorpe

*Assistant Examiner*—Cheryl J. Tyler

*Attorney, Agent, or Firm*—Larson & Taylor

[57] ABSTRACT

A vane cell (sliding vane) pump having a flow control valve (13) with a control piston (17). The control piston (17) operates as a pressure regulator, wherein a differential pressure that occurs with increasing pump speed is used as the measuring valve for the directly diverted conveyed flow. The directly diverted conveyed flow is introduced via a spray channel (25) into a distributing section (20), which is connected via curved suction arms (21,22) with suction zones (23,24). The distributing section (20) and the suction arms (21,22) nestle against a driveshaft such that the driveshaft acts as a flow divider. Additionally, the spray channel (25) terminates at the center of the distributing section (20) so that the sprayed off oil and the suction oil conveyed by the suction channel (18) is evenly divided between both suction zones (23,24). Since the hydraulic oil lubricates the driveshaft (12), no cavitation or abrasion can occur in this area.

4 Claims, 5 Drawing Sheets

SLIDING VANE PUMP USING A DRIVE SHAFT AS A FLOW DIVIDER FOR ENHANCED OIL CIRCULATION

BACKGROUND OF THE INVENTION

1. Field of the Invention

The invention relates to a vane cell pump with a cam ring seated in a housing and a rotor with radial slits, which can be driven by means of an input driveshaft. Work slides have been inserted into the radial slits, which sealingly slide along the cam ring. Work chambers are formed between the cam ring, the rotor and the work slides which are delimited in the axial direction by control plates. A flow control valve, which on the one side is fed by the conveying pressure and on the other by the outlet pressure plus a spring force, has been installed in the housing and can provide a connection from a pressure chamber to a spray channel connected with the suction side. In addition, a suction channel is divided into two symmetrically arranged curved suction arms located in the front wall of a housing, leading to suction zones.

2. Description of the Prior Art

A vane cell pump of this type is known, for example, from U.S. Pat. No. 5,112,199. This pump has two spray channels, which branch off the flow control valve and are connected with the two suction zones. In addition, the suction zones are also connected via two grooves with an inlet bore located below the flow control valve. Such a system with two spray conduits is comparatively expensive. It is furthermore possible that because of tolerances these conduits are activated in different ways when spraying the oil. This means that one of the two suction zones is fed only after a delay. Noise can be generated by the difference in filling of the suction zones.

Therefore the invention is based on the object of improving the pump in its spray and suction areas in such a way that an advantageous noise behavior results even at high pump rpm, along with small manufacturing costs.

SUMMARY OF THE INVENTION

This object is attained by the vane cell pump of the present invention in that the suction conduit terminates in a distributing section, which is located in the center in respect to the flow control valve and from which the curved suction arms radiate, wherein the distributing section and the curved suction arms are arranged in such a way that the input driveshaft or its friction bearing bush act as flow divider. In this case the spray conduit of the flow control valve terminates in the center of the distributing section.

In accordance with the preferred embodiment, the contour of the input driveshaft constitutes the inner channel wall in the distributing section and over a part of the length of the suction arms. The oil diverted in a directed manner at the flow control valve via the spray channel into the distributing section impacts on the input driveshaft and flows on both sides of the shaft without any great resistance over the curved suction arms into the suction zones. Since only one spray conduit is located in the center of the distributing section, the oil can be evenly distributed over the suction zones. The input acting as a flow divider has yet another advantage: since the oil, which is diverted in a directed manner at high speed at the flow control valve, impacts on the input driveshaft of hard steel, no cavitation or abrasion can take place at this location. In case of making the channel walls of diecast metal, of which, as a rule, the entire housing consists, such wear in the sensitive distributing area could not be ruled out.

Practical and advantageous embodiments of the invention are described herein. However, the invention is not limited to the combination of characteristics of the invention. For one skilled in the art, further useful possibilities of combining concepts and features of the invention ensue from the definition of the object.

In an alternative embodiment in accordance with the present invention, a friction bearing bush of the input driveshaft is embodied as a flow divider, wherein the slide bearing bushing extends approximately to the inner control plate. Because the friction bearing bush is designed as a two-component bearing, the diverted stream of the spray bore again impacts on the hard outer steel surface of the bushing.

In accordance with another embodiment, the bore of the flow control valve can be inclined, starting at a pressure chamber, by approximately 15° in the direction of the input driveshaft. This step results in an advantageous spray angle and therefore an improved degree of effectiveness (charging) of the directedly diverted oil.

In accordance with a further embodiment, leakage oil flows from the area of the rotor via the suction arms directly to the suction zones. Because of this step it is possible to omit a lubrication groove for the return of the oil in the friction bearing of the input driveshaft.

Only one combination of the layout and application is extensively represented in the specification. It is recommended to the reader to also consider every statement individually and to check its usefulness in other connections and combinations, this in particular in connection with the cited prior art. Obvious possibilities ensue for one skilled in the art, if the described steps are employed because of the advantages connected with them.

The invention will be described in detail below by means of several exemplary embodiments, making reference to the drawings.

BRIEF DESCRIPTION OF THE DRAWINGS

Shown in.

DETAILED DESCRIPTION OF THE PREFERRED EMBODIMENT

Vane cell pumps are used for conveying hydraulic oil from a reservoir, not shown, to a consumer, not shown, for example a power steering.

Figure 1:
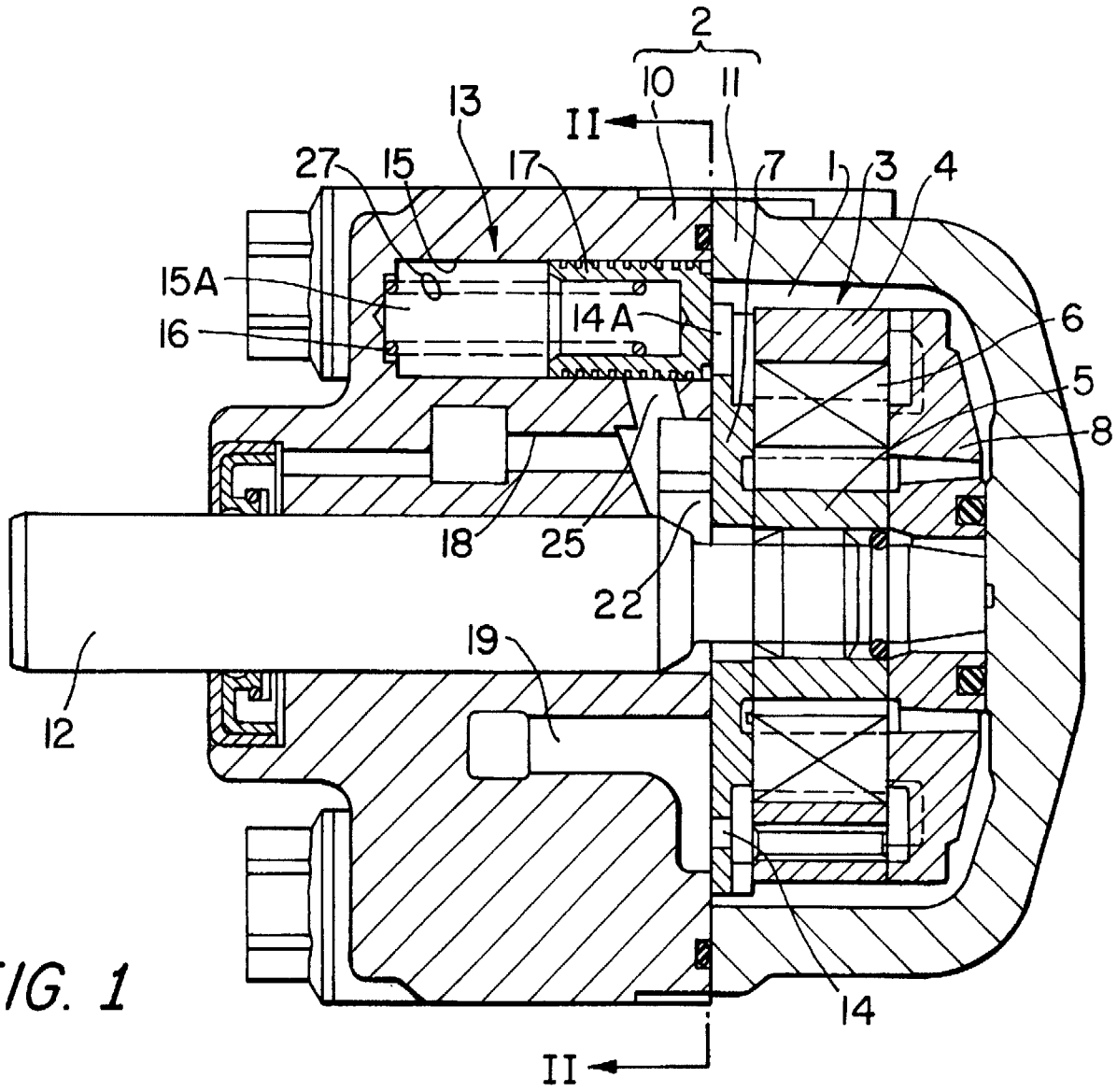
FIG. 1, a longitudinal section through a vane cell pump in accordance with the invention.
Figure 2:
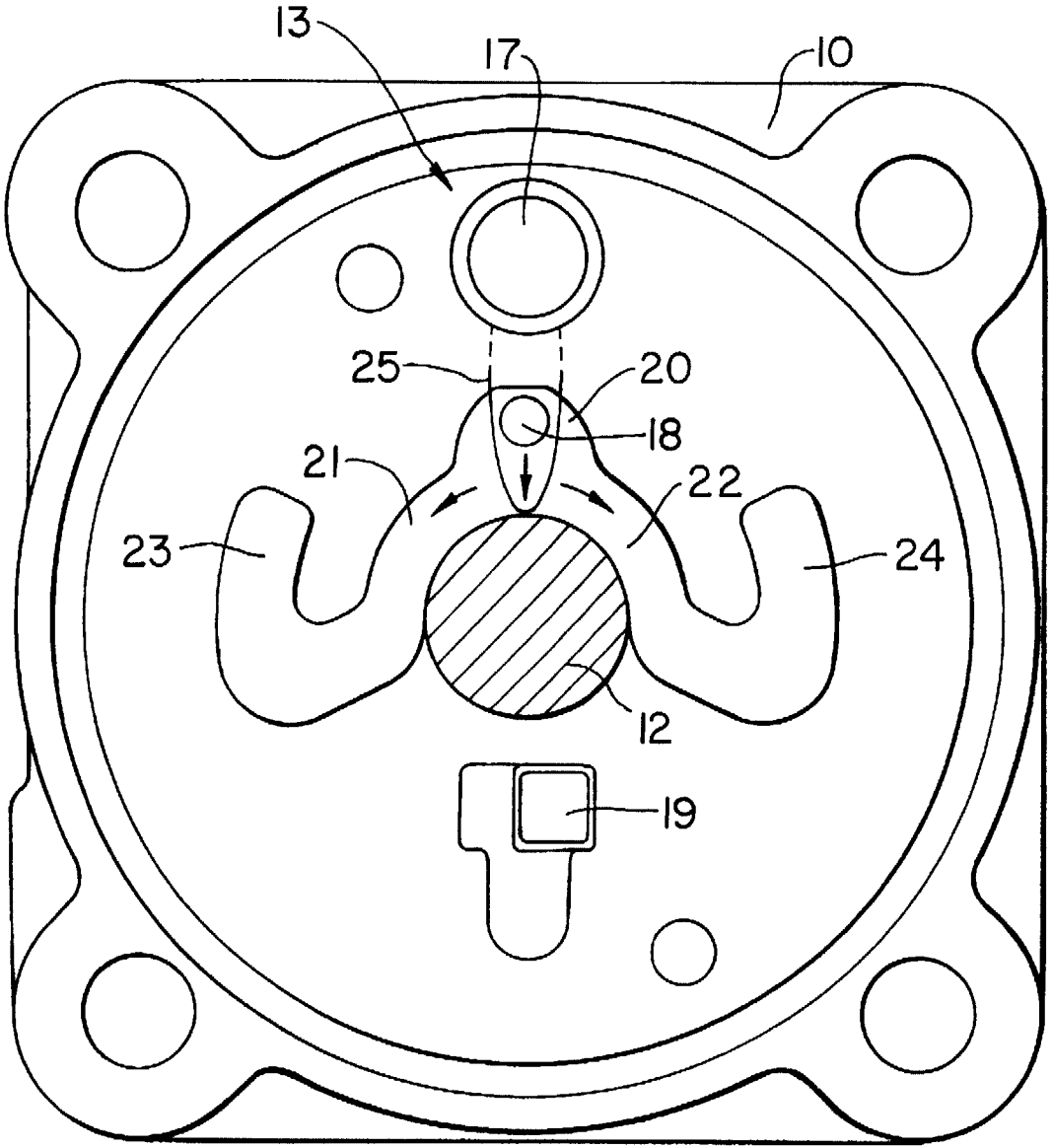
FIG. 2, a top view along the line II—II in FIG. 1.

In FIGS. 1 and 2, a rotor set 3 has been inserted in an oil filled pressure chamber 1 of a housing 2. The rotor set 3 consists of a cam ring 4 and a rotor 5. The rotor 5 is arranged in the interior of the cam ring 4 and has radially directed slits, in which vanes 6 can be displaced. Work chambers are formed between the cam ring, the rotor 5 and the vanes 6, which are delimited in the axial direction by control surfaces of adjoining control plates 7 and 8. The pump corresponds to a double-stroke embodiment.

The housing 2 is put together from a bearing housing 10 and a cup-shaped housing cover 11. The rotor 5 is seated, fixed against relative rotation, on a driveshaft 12, which is supported in the bearing housing 10. The bearing point in the bearing housing 10 is the only seating of the driveshaft 12. This means that the driveshaft 12 is not seated in the radial direction in the housing cover 11. Instead, the driveshaft is supported in the axial direction on the housing cover 11.

Besides a suction connection, not shown, for connecting the reservoir and an also not shown hydraulic connection for the consumer, a flow control valve 13 is provided in the bearing housing 10 for controlling the hydraulic oil supplied to the hydraulic connector. The embodiment of the flow control valve 13 and of an additionally provided, but not shown pressure relief valve is generally known, for example from U.S. Pat. No. 5,098,259, and will therefore not be described in detail. The hydraulic conduits which connect the work chambers with the flow control valve 13 and the pressure relief valve are arranged in the bearing housing in the same way. These conduits are also generally known and will therefore not be described in detail.

The control plate 7 has a throttle 14 and an opening 14A. The throttle and the opening are connected with the pressure-feed work chambers formed between the rotor 5, the cam ring 4 and the vanes 6. In this case the conveying pressure prevails in the pressure chamber 1. The conveying pressure is supplied to the consumer via the throttle 14 and an outlet channel 19. A piston bore 15 of the flow control valve 13 axially adjoins the opening 14A. The piston bore 15 contains a control piston 17, on which a spring 16 inserted into a spring chamber 15A acts. The piston bore 15 is connected with the outlet conduit 19 via a bore 27. As can best be seen from the top view of FIG. 2, a suction channel 18 is connected via a distributing section 20 and two curved suction arms 21 and 22 with suction zones 23 and 24. It is advantageous for the flow to let the suction channel 18 connected to the reservoir terminate in the center of the distributing section 20. In a known manner the suction zones 23 and 24 constitute the inlets of the work chambers of the pump, which are located between the vanes 6. In accordance with the invention, the distributing section 20 is centrally located under the flow control valve 13. The distributing section 20 and the suction arms 23 and 24 are arranged in such a way that the driveshaft 12 acts as a flow divider. Therefore the driveshaft forms a portion of the interior conduit wall. A spray channel 25 of the flow control valve 13 terminating centrally in the distributing section 20 is a further part of the invention. The control piston 17 of the flow control valve 13 controls the excess flow conveyed at higher rpm and directs it into the suction zones 23, 24. Since the driveshaft 12 constitutes the inner conduit wall of the distributing section 20 and the suction arms 21, 22, a course of the channel which is advantageous to the flow and has a good feed effect is obtained, with an even distribution of the entire suction flow. In the process, the stream rushing via the spray channel 25 into the distributing section 20 drags along the oil brought through the suction channel 18, because of which feeding is additionally improved. In this connection it is advantageous if the spray channel 25 is inclined toward the distributing section 20 (FIG. 1), so that the stream entering the spray channel 25 impacts on the driveshaft 12 made of a hard material, and not on the channel wall. It is possible by means of this to prevent cavitation and abrasion in the spray channel 25. The leakage oil from the area of the rotor 5 can usefully be returned via the suction arms 21, 22 directly to the suction zones 23, 24.

Figure 3:
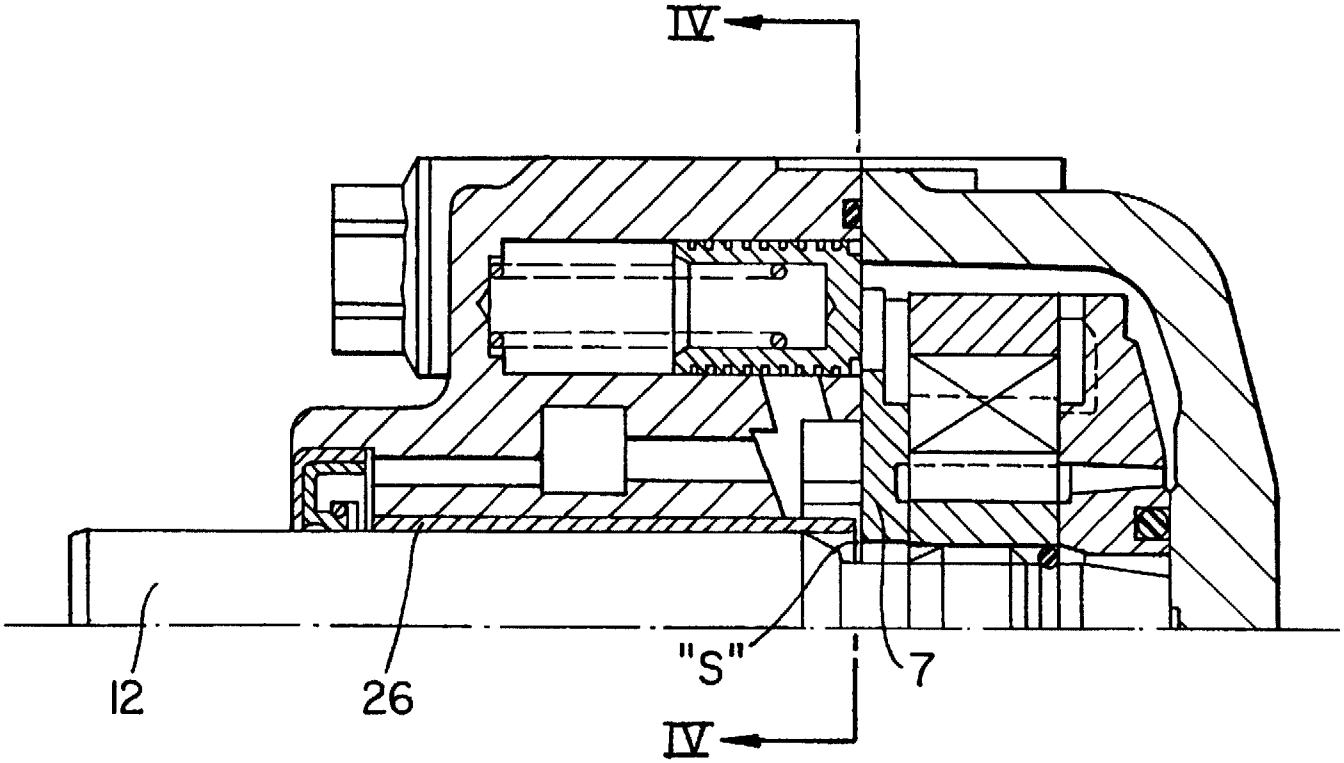
FIG. 3, a partial longitudinal section through an embodiment with a driveshaft seated in a slide bearing bushing.
Figure 4:
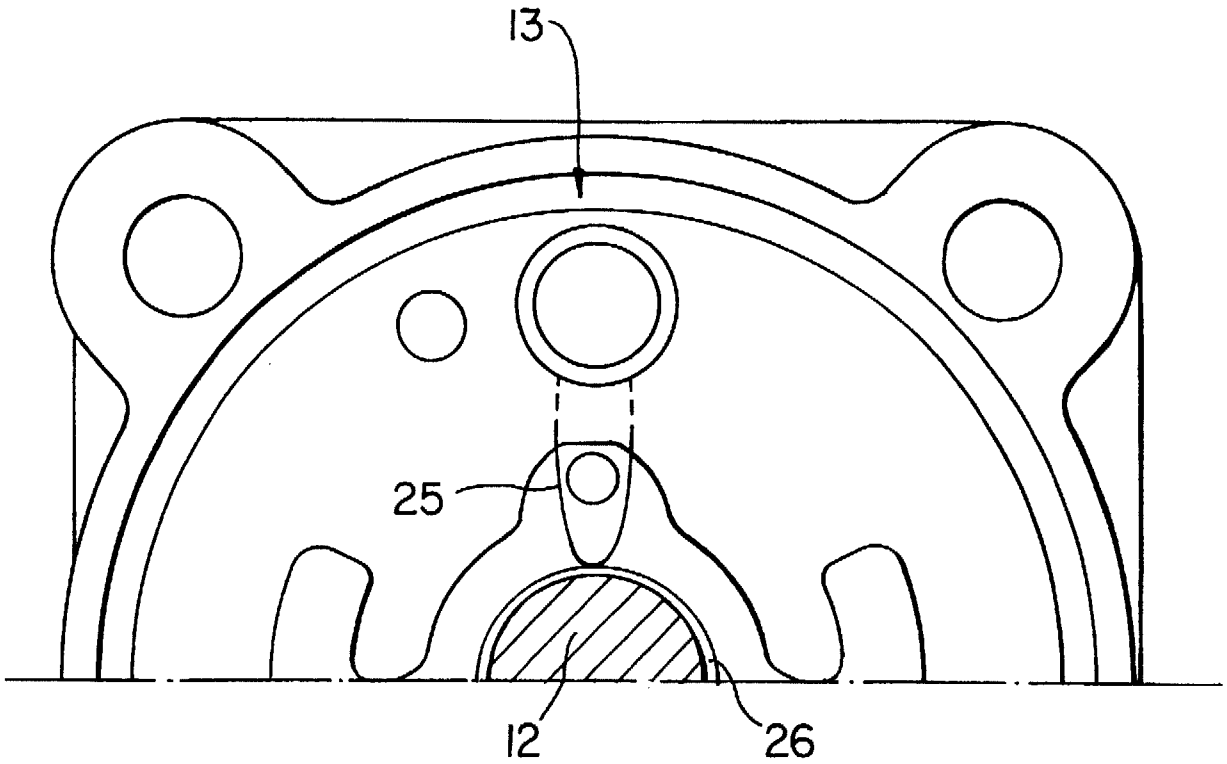
FIG. 4, the cross section along the line IV—IV in FIG. 3.

In FIGS. 3 and 4 the driveshaft 12 is supported on a friction bearing bush 26. The bush 26, which acts as a flow divider, is embodied as a two-component bearing, i.e. the outer jacket consists of steel, for example, while the inner surface is made of nonferrous metal. The same advantages result here as already mentioned in connection with FIG. 1. If a small gap "S" is left free between the face plate 7 and the friction bearing bush 26, leakage oil again can flow through this gap from the area of the rotor 5 to the suction arms 21, 22 and therefore to the suction zones 23, 24.

Figure 5:
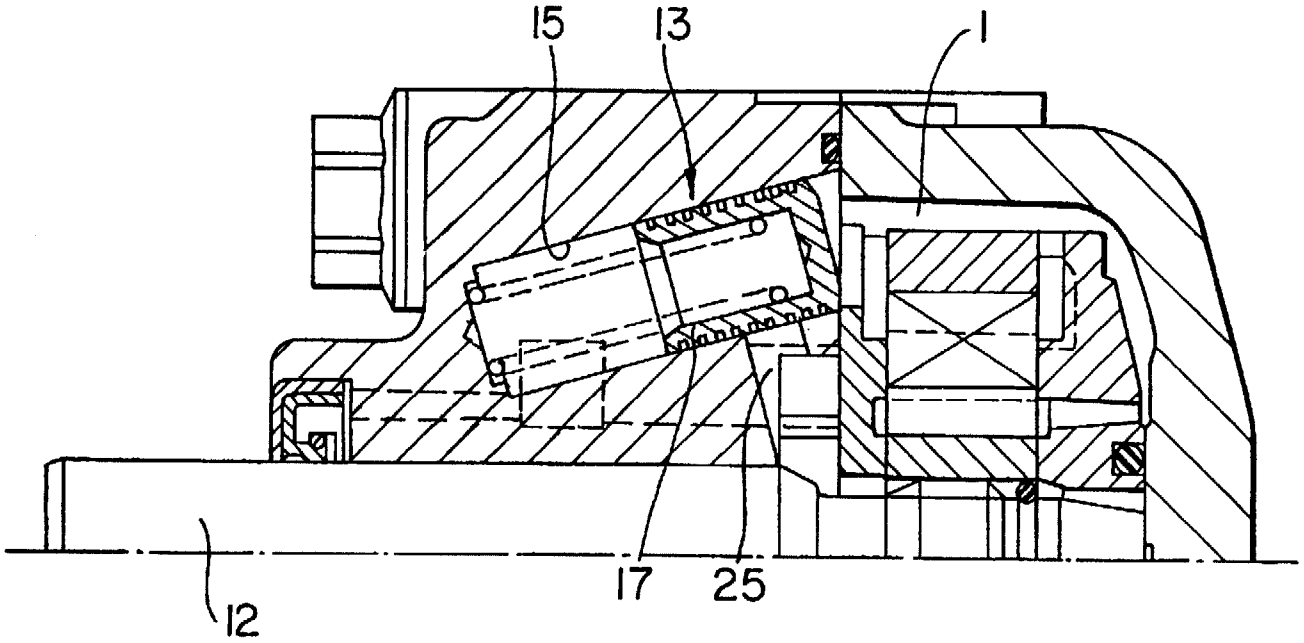
FIG. 5, a partial longitudinal section through a further embodiment with a transversely arranged flow control valve.

A further variant is represented in FIG. 5, wherein, starting at the pressure chamber 1, the piston bore 15 of the flow control valve 13 is inclined by approximately 15° in the direction toward the driveshaft 12. This step has the advantage that, when opened by the control piston 17, the piston bore is directed perpendicular or nearly perpendicular with the spray channel 25 over a wide area, and the oil stream impacts on the cavitation-resistant driveshaft 12.

The flow control valve 13 operates as follows:

With increasing rpm the differential pressure on the front face of the control piston 22 facing the opening 14A increases because of the throttle 14. The control piston 22 acts as a pressure regulator and is displaced toward the left against the force of a spring 23 and the force of the outlet pressure prevailing behind the control piston. In the process the front face of the control piston 22 opens the spray channel 25. In this way a partial flow gets back to the inflow side of the pump in a known manner. This results in a horizontal or descending useful flow characteristic curve.

I claim:

1. A vane cell pump comprising:

a cam ring seated in a housing having a front wall;

a rotor, which is driven by means of a driveshaft, has radial slits in which work slides are inserted that sealingly slide along the cam ring;

work chambers are formed between the cam ring, the rotor and the work slides, which work chambers are delimited in the axial direction by control plates;

a flow control valve, which on the one side is fed by the conveying pressure and on the other side by an outlet pressure plus a spring force, is located in the housing, which provides a connection from a pressure chamber to a spray channel;

a suction channel is divided into two symmetrically arranged curved suction arms located in the front wall of the housing, leading to suction zones, the improvement comprising;

the suction channel terminating in a distributing section, which is located in the center of the flow control valve, from which the curved suction arms radiate, the distributing section and the curved suction arms are being arranged in such a way that the driveshaft acts as flow divider, and the spray channel of the flow control valve terminating centrally in the distributing section.

2. The vane cell pump in accordance with claim 1, wherein a friction bearing bush of the driveshaft acts as a flow divider and the friction bearing bush extends up to the vicinity of an inner control plate.

3. The vane cell pump in accordance with claim 1, wherein the bore of the flow control valve, which contains a control piston, is inclined, starting at a pressure chamber, by approximately 15° in the direction of the driveshaft.

4. The vane cell pump in accordance with claim 1, wherein leakage oil from the area of the rotor flows via the suction arms directly to the suction zones.

* * * * *